United States Patent [19]

Nakajima et al.

[11] 4,392,423

[45] Jul. 12, 1983

[54] PRINTING HAMMER DRIVING APPARATUS

[75] Inventors: Isao Nakajima, Iwamamachi; Koji Tagusari; Kenji Okuna, both of Shimoinayoshi; Toru Hayama, Kashiwa; Kazue Takahashi, Shimoinayoshi; Michihiro Watanabe, Shimoinayoshi; Sumihisa Kotani, Shimoinayoshi, all of Japan

[73] Assignees: Hitachi, Ltd.; Hitachi Koki Co., Ltd., both of Tokyo, Japan

[21] Appl. No.: 153,318

[22] Filed: May 27, 1980

Related U.S. Application Data

[63] Continuation-in-part of Ser. No. 7,982, Jan. 1, 1979, abandoned.

[30] Foreign Application Priority Data

Feb. 8, 1978 [JP] Japan ..... 53-12398
Mar. 29, 1978 [JP] Japan ..... 53-35481

[51] Int. Cl.[3] ..... B41J 9/02

[52] U.S. Cl. ..... 101/93.48; 101/93.29; 101/93.34

[58] Field of Search ..... 101/93.02, 93.29, 93.30, 101/93.31, 93.32, 93.33, 93.34, 93.48

[56] References Cited

U.S. PATENT DOCUMENTS

| | | | |
|---|---|---|---|
| 3,196,783 | 7/1965 | Gross | 101/93.29 X |
| 3,351,006 | 11/1967 | Belson | 101/93.33 X |
| 3,609,609 | 9/1971 | Bertazzi | 101/93.29 X |
| 3,705,370 | 12/1972 | Chai et al. | 101/93.48 X |
| 3,714,892 | 2/1973 | Perry | 101/93.48 |
| 3,726,213 | 4/1973 | Herbert | 101/93.33 |
| 3,747,521 | 7/1973 | Hamilton et al. | 335/297 X |
| 4,018,155 | 4/1977 | Cargill | 101/93.34 X |
| 4,121,518 | 10/1978 | Prior et al. | 101/93.48 X |
| 4,224,589 | 9/1980 | Tamulis | 101/93.29 X |

OTHER PUBLICATIONS

Mulzet et al., IBM Tech. Discl. Bulletin, vol. 16, No. 11, Apr. 1, 1974, pp. 3529–3531.

Gilbert et al., IBM Tech. Discl. Bulletin, vol. 17, No. 3, Aug. 1974, pp. 780–781.

Tashjian et al., IBM Tech. Discl. Bulletin, vol. 10, No. 11, Apr. 1968.

Luoma, IBM Tech. Discl. Bulletin, vol. 17, No. 1, Jun. 1974, pp. 340–341.

*Primary Examiner*—Edward M. Coven

*Attorney, Agent, or Firm*—Antonelli, Terry & Wands

[57] ABSTRACT

A printing hammer driving apparatus for high-speed printers comprises a lever member acting as a hammer operating part, an armature forming a part of a magnetic circuit, and an electromagnet forming, together with the armature, the magnetic circuit. The lever member has a rotational supporting point at the base end thereof and is made of a light-weight non-magnetic material. The armature is projected in one of the rotational directions of the lever member from the intermediate part of the lever member. The electromagnet has at least one core and an exciting coil wound on the core. A core has a magnetic pole face perpendicular to the direction of attraction of the armature and a magnetic pole face parallel to the direction of attraction of the armature. The magnetic pole face perpendicular to the direction of armature attraction is opposed with a gap to the forward end face of the armature, and the magnetic pole face parallel to the direction of armature attraction is opposed with a gap to the surface of the armatures parallel to the direction of attraction thereof.

2 Claims, 8 Drawing Figures

PRINTING HAMMER DRIVING APPARATUS

BACKGROUND OF THE INVENTION

This application is a continuation in part of copending U.S. application Ser. No. 7,982, filed Jan. 1, 1979, abandoned.

FIELD OF THE INVENTION

The present invention relates to a printing hammer driving apparatus for high-speed printers, or more in particular to a printing hammer driving apparatus for high-speed line printers.

DESCRIPTION OF THE PRIOR ART

The prior art printing hammer driving apparatus for printers comprise a U-shaped core wound with an exciting coil, making up a magnetic circuit, and an armature having a rotational supporting point at an end thereof and with an intermediate part thereof making up a magnetic circuit.

In this type of printing hammer driving apparatus, there is an increasing demand for a higher printing speed. In order to increase the printing speed, the hammering speed for printing is required to be increased, which in turn requires a higher speed of moving the armature. This purpose may be achieved either by increasing attraction force of the armature or by reducing the weight of the armature. The attraction force of the armature is proportional to the square of magnetic fluxes in the gap between the surface of the magnetic pole of the core and the end surface of the armature opposed thereto. Therefore, if the attraction force is to be increased, the magnetic flux is required to be increased. The magnetic fluxes can be increased by increasing the sectional area of the magnetic circuit, thus reducing the magnetic reluctance of the magnetic circuit. An increased sectional area of the armature, however, has the disadvantage that although it contributes to an increased attraction force, the weight of the armature is increased, thereby offsetting the effect of the increased attraction force.

As noted from the foregoing explanation, the conventional printing hammer driving apparatus have a number of limitations against the requirement to move the armature at high speed. This has made it impossible to attain a sufficiently high printing speed in the prior art printing hammer driving apparatuses.

Another type of the conventional hammer for the printing hammer driving apparatus is disclosed in U.S. Pat. No. 3,714,892. This hammer uses a thermoplastic material instead of a metal material for the hammer body and utilizes the elasticity of the thermoplastic material to whip the hammer face at the forward end thereof on the anvil.

SUMMARY OF THE INVENTION

An object of the present invention is to provide a printing hammer driving apparatus which is capable of increasing the printing speed of the printers.

Another object of the invention is to provide a printing hammer driving apparatus having a novel core structure capable of attracting the armature at high speed.

A further object of the present invention is to provide a printing hammer driving apparatus in which a lever member having the armature is set to have such a lever ratio that the maximum speed of the armature is attained, the lever ratio being defined as the ratio between the distance from the rotational supporting point of the lever member to the armature and the distance from the same supporting point to the striking point.

According to the present invention, there is provided a printing hammer driving apparatus capable of high speed printing, comprising: a lever member having a supporting point at the base end thereof and a hammer-operating portion at the other end thereof, the lever member being made of a light-weight non-magnetic material; an armature making up a part of a magnetic circuit and mounted on the lever member at the intermediate position thereof in such a manner as to project in one direction of rotation of the lever member; and an electromagnet for forming a magnetic circuit in cooperation with the armature, the electromagnet including a core and an exciting coil wound on the core having one magnetic pole face at a right angle to the direction of attraction of the armature and another magnetic pole face parallel to the direction of attraction of the armature, the one magnetic pole face at a right angle to the direction of attraction of the armature being opposed with a gap to the other end face of the armature, the other magnetic pole face parallel to the direction of attraction of the armature being opposed with a gap to the face of the armature parallel to the direction of attraction thereof.

DESCRIPTION OF THE PREFERRED EMBODIMENTS

Figure 1:
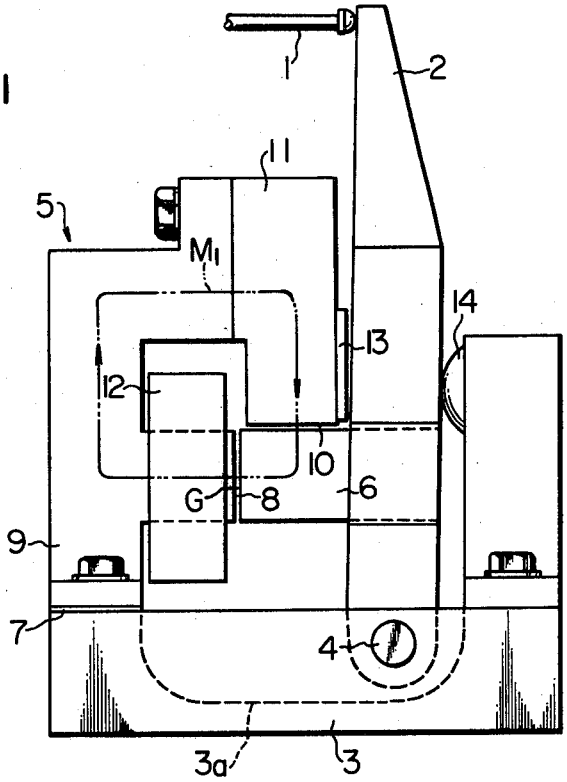
FIG. 1 is a front view showing an example of the printing hammer driving apparatus according to the present invention.

The diagram of FIG. 1 shows an example of the printing hammer driving apparatus according to the present invention. In the drawing, a push rod 1 has a hammer (not shown) at the other end thereof. In response to the axial movement of the push rod 1, the hammer presses the paper and an ink ribbon by impact against a type for effecting a print on the paper. The axial movement of the push rod 1 is effected by the swing of the lever member 2. The base end of the lever member 2 is inserted into a recess 3*a* of the base 3 and rotatably mounted in the base 3 by a rotary shaft 4. The other end of the lever member 2 is in contact with the push rod 1. An armature 6 related to an electromagnet means 5 described later is projected from the intermediate part of the base side part of the lever member 2. The length of projection of the armature 6 is set at a minimum required for forming the magnetic circuit. By projecting the armature 6 from the lever member 2, the lever member 2 is excluded from the magnetic circuit $M_1$ formed by the electromagnet means 5. As a result, the lever member 2 is not required to be made of a magnetic material but may be constructed of a light-weight material such as plastics.

The electromagnet means 5 is fastened to the base 3 through a non-magnetic material 7 in order to prevent leakage of magnetic fluxes. This electromagnet means 5 includes a core 9 having a magnetic pole face 8 perpendicular to the direction of attraction of the armature, a core 11 mounted on the core 9 in proximity to the magnetic pole face 8 and having a magnetic pole face 10 parallel to the direction of attraction of the armature, and an exciting coil 12 wound the core 9. The armature 6 is arranged in opposed relation to the magnetic pole face 8 of the core 9 and the magnetic pole face 10 of the core 11. A stopper 13 is mounted on that part of the core 11 which is opposed to the lever member 2.

A back stop member 14 is mounted on the part of the base 3 on the back of the lever member 2 in order to dampen the swing of the lever member 2. The lever member 2 is pressed against the back stop member 14 by a return spring (not shown) during the de-energization of the electromagnet means 5.

Figure 2:
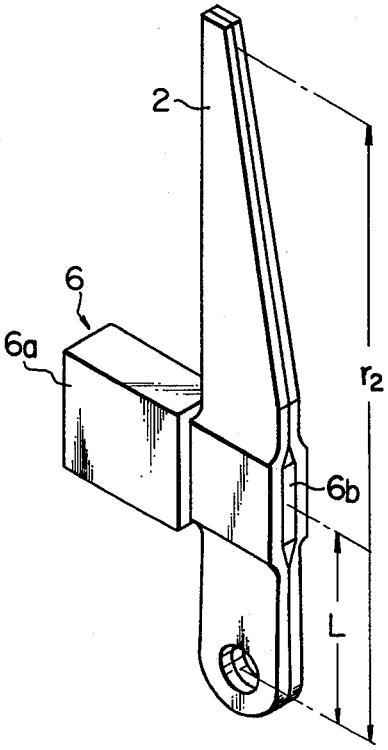
FIG. 2 is a perspective view showing an example of the lever member used with the apparatus according to the present invention.

The lever member 2 is coupled to the armature 6 in the manner mentioned below as shown in FIG. 2, for example. The armature 6 of a magnetic material is formed with an adsorbing part 6*a* integrated with a coupling part 6*b*, which is coupled with the lever member 2 of a light material such as a composite material by bonding agent or the like. The lever member 2 may be made of either a non-metallic material or a light metal such as magnesium. The method for coupling the armature 6 to the lever member 2 may also take the form of direct metal-to-metal contact such as diffusion coupling or other mechanical one such as by use of caulking as well as a bonding agent. A wear-resistant material is preferably applied to that side of the lever member 2 which faces the electromagnet 5 in order to prevent wear which otherwise might occur due to the corrision with the push rod 1 and stopper 13.

The operation of an example of the printing hammer driving apparatus according to the present invention mentioned above will be explained below.

Assume that the exciting coil 12 of the electromagnet means 5 is excited under the condition shown in FIG. 1. The magnetic circuit $M_1$ is formed in the cores 9 and 11 of a magnetic material and the armature 6. As a result, a force of attraction occurs in the gap G between the magnetic pole face 8 of the core 9 and the end face of the armature 6 opposed thereto. The lever member 2 thus far pressed against the back stop member 14 by the return spring is attracted to the cores 9 and 11 together with the push rod 1 with the shaft 4 as a supporting point. When subsequent attraction of the armature 6 causes the lever member 2 to come into contact with the stopper 13 of the core 11, only the push rod 1 continues to move toward the upper left in the drawing. Thus, the hammer at the other end of the push rod 1 pressed the paper and ink ribbon by impact against a type, with the result that a predetermined character or letter is printed on the paper.

The above-mentioned printing operation is performed at high speed depending on the correlation among three factors including weight reduction of the lever member 2, core structure of the electromagnet means 5 and the lever ratio of the lever member 2. More specifically, the first factor, i.e., the reduction of weight of the lever member 2 is realized by the construction thereof independent of the magnetic circuit, thus making it possible to increase the speed of the lever member 2.

Referring to the second factor, i.e., the core structure of the electromagnet means 5, it is difficult to reduce the magnetic reluctance thereof by enlarging the sectional area of the lever member in the case of the conventional apparatuses in which the lever member doubles as the armature, the reason being that the lever member is made of a magnetic material which is considerably heavy. In such conventional apparatus, therefore, the force of attraction cannot be increased. According to the present invention, by contrast, the core 11 may take any shape regardless of the lever member 2, and therefore the magnetic reluctance may be reduced without increasing the weight of the lever member 2, thus making it possible to increase the force of attraction contributing to an increased speed of the printing hammer driving apparatus.

The third factor also has an important relation with an increased speed of the printing hammer driving apparatus. In other words, a change in the lever ratio R of the lever member 2 (defined as the ratio of the distance L from the rotational shaft 4 to the armature 6 and the distance $r_2$ from the rotary shaft 4 of the contact point of the push rod 1) causes a change in the speed of the lever member 2 at the contact point of the push rod 1, and the "equivalent mass" and attraction force of the lever member 2. For any given driving apparatus, an optimum lever ratio exists to attain the maximum speed of the particular lever member 2. Because the lever member in prior art devices makes up part of the magnetic circuit, such a lever member has been designed with an eye toward its role in the magnetic circuit with a lever ratio being utilized which is not necessarily the optimum ratio. According to the present invention, on the other hand, a desired shape or form of the lever member 2 may be selected independent of the magnetic circuit, so that a further increase in the speed of the printing hammer driving apparatus is possible by optimization of the lever ratio. The fact that the optimum lever ratio may be selected will be explained below with reference to the equivalent mass $M_{eq}$, i.e. the mass which is equivalent to that of the unit formed by the lever with the armature mounted thereto when considered as a single inertial body and FIGS. 3 and 8.

Viewing the force interactions involved, for a given magnetic attractive force applied via the armature 6 to the lever 2, $F_m$, an action force $F_{eq}$ is transferred to push rod 1 at its contact point on the lever 2 which follows the relationship $F_{eq}=(1/R)\cdot F_m=(LF_m/r_2)$. Additionally, the rate of acceleration of lever 2, $d^2\theta/dt^2$, where $\theta$ is the angle through which lever 2 rotates, can be expressed as $(d^2\theta/dt^2)=(F_m\cdot L/J)=(F_{eq}\cdot r_2/J)$, where J equals the moment of inertia. It has further been determined that the moment of inertia can be expressed by the equation $J=M_{eq}\cdot r_2^2$ so that it can be seen that the acceleration of the lever 2, and therefore its speed, can be increased by minimizing the equivalent mass $M_{eq}$, even though the magnitude of the attractive and action forces $F_m$ and $F_{eq}$ remain constant.

For the illustrated arrangements wherein lever 2 carries armature 6, the equivalent mass thereof is the summation of the equivalent masses $m_1$ of the armature 6 and $m_2$ of the lever (i.e., $Meq=m_1+m_2$) can be expressed by the equations $m_1=J_1/r_2^2$; $m_2=J_2/r_2^2$, where $J_1+J_2$ are the moment of inertia of the armature 6 and lever 2, respectively. Since the relationships defining the values for the moments of inertia of solids are known, these values for the moment of inertia, in turn, can be substituted in the above equations yielding the relationships $m_1=k_1+k_2\cdot(1/L^2)$; $m_2=k_3\cdot L$, where $k_1$, $k_2$ and $k_3$ are radius of gyration constants defined for the particular configuration.

Figure 8:
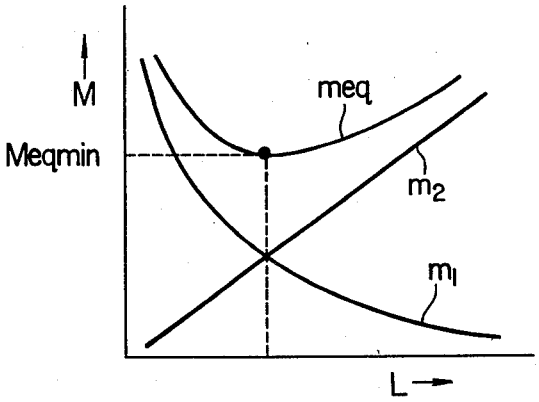
FIG. 8 is a diagram showing the relation between mass the distance between the pivot axis of the lever member and the point at which the lever rod contacts the push rod.

Therefore, it is possible to determine the distance L which can best serve to minimize the equivalent mass $M_{eq}$ under circumstances where the lever ratio R is constant. This can be clearly seen with reference to applicants' experimentally determined characteristics shown in FIGS. 3 and 8. The diagram of FIG. 8 shows that, under the noted circumstances where the lever ratio R is constant, an exponentially decreasing relationship exists for $m_1$ with increases in distance L, while a proportionally increasing relationship exists for $m_2$ with the net result that the minimum value $M_{eq}$, $M_{eqmin}$ is readily observed.

Figure 3:
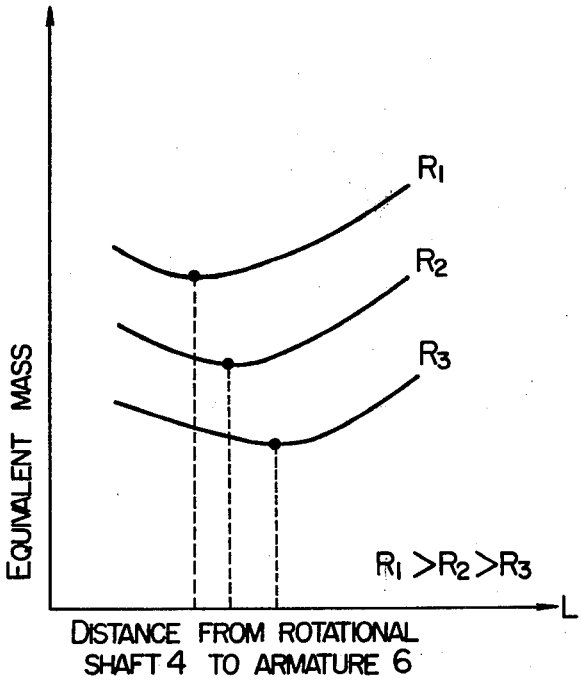
FIG. 3 is a diagram showing the lever ratio for attaining the minimum mass of the lever member of the apparatus according to the present invention.

The diagram of FIG. 3 shows the relation between the distance L from the rotational shaft 4 to the armature 6 and the equivalent mass of the lever member 2 including the armature 6 with the lever ratio R of the lever member 2 as a parameter. The relation between the distance L and the equivalent mass of the lever member 2 at the lever ratios $R_1$ to $R_3$ represents curves as shown in the drawing. If the value of the lever ratio R is determined, therefore, it is possible to select the proper value of the distance L minimizing the equivalent mass of the lever member 2. In the conventional apparatus however, the distance L minimizing the equivalent mass of the lever member 2 is not necessarily selected due to the above-mentioned limitations. According to the present invention, by contrast, the value of distance L is determined as desired since it does not form part of the magnetic circuit thus making it possible to minimize the equivalent mass of the lever member 2 against each value of lever ratio R. Put another way, the distance L can be adjusted until it corresponds to a minimum value of equivalent mass for a resulting lever ratio, where conditions of usage govern the length $r_2$.

Figure 4:
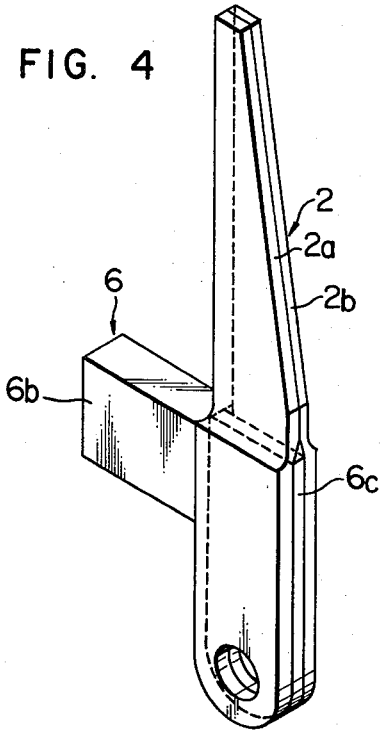
FIG. 4 is a perspective view of another example of the lever member used with the apparatus according to the present invention.
Figure 5:
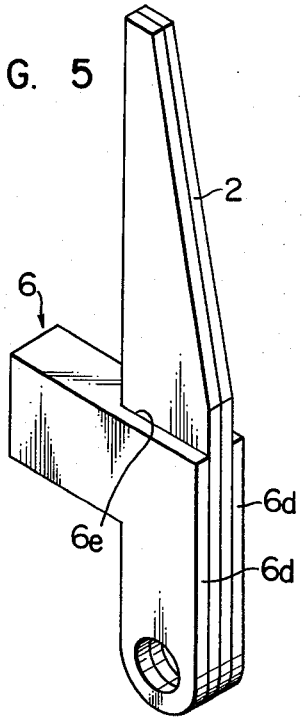
FIG. 5 is a perspective view of still another example of the lever member used with the apparatus according to the present invention.

Other examples of the coupling structure between the lever member 2 and the armature 6 will be explained with reference to FIGS. 4 and 5. Referring to the coupling structure of FIG. 4, the armature 6 is formed an inverted L and includes an adsorbing part **6*b* and a coupling part 6*c* to the lever member 2. Two members 2*a* and 2*b* making up the lever member 2 are coupled under pressure to the coupling part 6*c* of the armature 6 by a bonding agent. This coupling structure is such that the coupling area between the lever member 2 and the armature 6 is larger, and the coupling by pressure leads to a very high coupling strength between the lever member 2 and the armature 6. Also, the area of the coupling part 6*c* of the armature 6 is so large that heat generated at the adsorbing part 6*b* of the armature 6** is sufficiently dissipated.

Next, explanation will be made of the coupling structure shown in FIG. 5. The armature 6 is formed also generally an inverted L in a manner somewhat similar to the embodiment of FIG. 4, and the back of the coupling part **6*d* has a slot 6*e*, in which the lever member 2 is fitted. The lever member 2 and the coupling part 6*d* of the armature 6 are coupled to each other under pressure by a bonding agent. This coupling structure is expected to have substantially the same effect as the embodiment of FIG. 4**. Especially, in this embodiment, the heat dissipation effect is higher than the above-mentioned embodiment.

Figure 7:
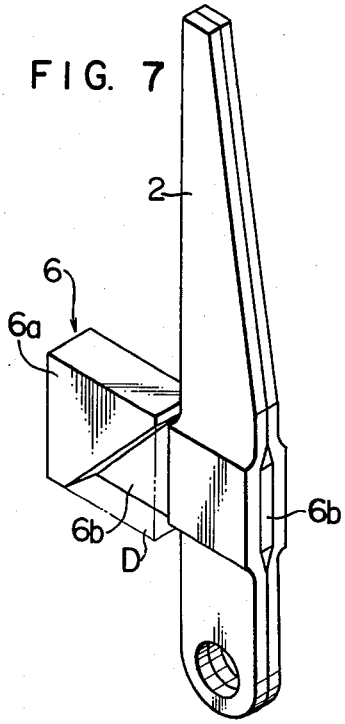
FIG. 7 is a perspective view showing another example of the lever member used with the apparatus according to the present invention.
Figure 6:
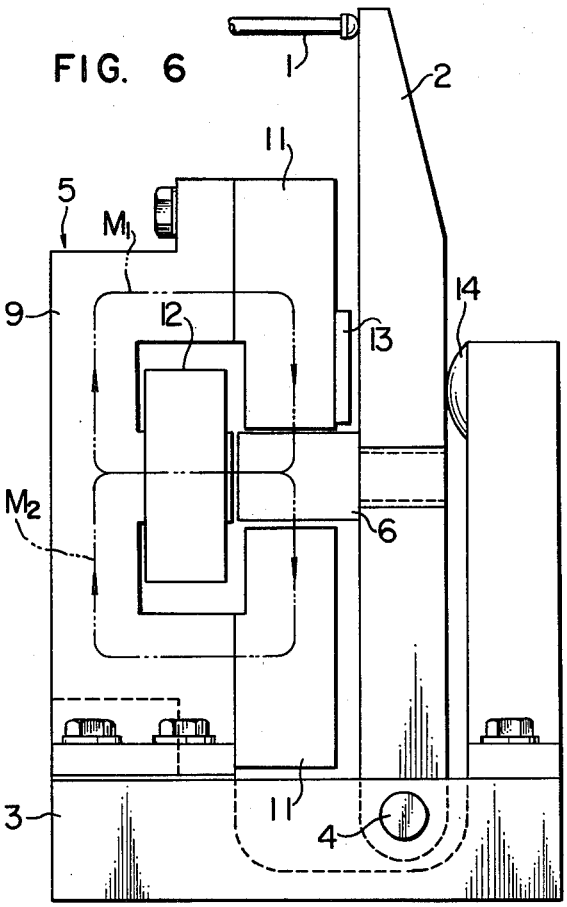
FIG. 6 is a front view showing another example of the printing hammer driving apparatus according to the present invention.

In the above-described embodiments, the electromagnet means 5 and the armature 6 make up one magnetic circuit $M_1$. Instead of this construction, the two cores 11 may be mounted on the electromagnet means 5 so that the cores 9 and 11 and the armature 6 constitute the magnetic circuits $M_1$ and $M_2$ as shown in FIG. 6. Further, in order to reduce the weight of the lever member 2 as a whole including the armature 6, the portion D which is not involved in the formation of the magnetic circuit at the adsorbing part **6*a* of the armature 6 may be removed as shown in FIG. 7. Furthermore, as an alternative to the system of the above-mentioned embodiment in which the push rod 1 is moved by the lever member 2, the lever member 2 may be used directly as a hammer. Also, the supporting point structure of the lever member 2** may be constructed of a spring support.

As described in detail above, in the apparatus according to the present invention, that one of the magnetic circuits formed by the core and the armature doubling as the lever member which is generated in the armature in the prior apparatuses is transferred to the core side, thus constructing the core with a minimum magnetic circuit on armature side. At the same time, the lever member is made of a non-magnetic material.

Therefore, as compared with the conventional apparatuses, the force of attraction is increased due to the core structure, and the lever member is reduced in weight, thus realizing a higher speed of the printing hammer driving apparatus. As a result, the printing speed is extremely improved.

We claim:

1. A printing hammer driving apparatus capable of high speed printing, comprising:

a lever member made of a light-weight non-magnetic material, said lever member having a base end used as a rotational supporting point and another end thereof used as a push rod operating part to drive a printing hammer, an armature mounted to project from an intermediate part of said lever member in a direction of rotation of said lever member about said supporting point, and an electromagnet including at least a core and an exciting coil wound on said core, said core of said electromagnet having at least two magnetic pole faces which are opposed to said armature with gaps therebetween, wherein for a given ratio of a distance (L) from the rotational supporting point of said lever member to said armature to a distance ($r_2$) from said rotational supporting point to a contact point at which said lever member acts as the push rod operating part, said armature is mounted on said lever member having the distance $r_2$ to said operating part at a position corresponding to said distance (L) so that the equivalent mass of said lever member with said armature mounted thereto is minimized.

2. A printing hammer driving apparatus capable of high speed printing, comprising:

a lever member made of a light-weight non-magnetic material, said lever member having a base end used as a rotational supporting point and another end thereof used as a push rod operating part to drive a printing hammer;

an armature mounted to project from an intermediate part of said lever member in a direction of rotation of said lever member about said supporting point;

an electromagnet including at least a core and an exciting coil wound on said core, said core of said electromagnet having at least two magnetic pole faces which are opposed to said armature with gaps therebetween; and means mounting said armature on said lever at a position for producing a minimum value of the equivalent mass of said lever member with said armature mounted thereto for a resulting ratio of a distance (L) from the rotational supporting point of said lever member to said armature to a distance ($r_2$) from said rotational supporting point of said lever member to a contact point at which said lever member acts as the push rod operating part.

* * * * *

UNITED STATES PATENT AND TRADEMARK OFFICE

CERTIFICATE OF CORRECTION

PATENT NO. : 4,392,423

DATED : July 12, 1983

INVENTOR(S) : Isao NAKAJIMA et al

It is certified that error appears in the above-identified patent and that said Letters Patent is hereby corrected as shown below:

On the Title Page, left-hand column:

[63] "Continuation-in-part of Ser. No. 7,982, Jan. 1, 1979," should read:

--Continuation-in-part of Ser. No. 7,982, Jan. 31, 1979,--; and

Column 1, Line 6, i.e., the second line of the "BACKGROUND OF THE INVENTION", "Jan. 1, 1979" should read:

--Jan. 31, 1979--.

Signed and Sealed this

*Twenty-first* Day of *February 1984*

[SEAL]

*Attest:*

GERALD J. MOSSINGHOFF

*Attesting Officer*

*Commissioner of Patents and Trademarks*